United States Patent [19]

Lonati

[11] Patent Number: 4,932,226

[45] Date of Patent: Jun. 12, 1990

[54] DEVICE FOR LOCKING SELECTORS ON THE BOTTOM OF NEEDLE CYLINDER GROOVES IN CIRCULAR KNITTING MACHINES

[75] Inventor: Francesco Lonati, Brescia, Italy

[73] Assignee: Lonati S.p.A., Brescia, Italy

[21] Appl. No.: 230,541

[22] Filed: Aug. 10, 1988

[30] Foreign Application Priority Data

Aug. 20, 1987 [IT] Italy ..... 21684 A/87

[51] Int. Cl.[5] ..... D04B 15/66

[52] U.S. Cl. ..... 66/8; 66/222

[58] Field of Search ..... 66/8, 40, 42 R, 222, 66/223, 224

[56] References Cited

U.S. PATENT DOCUMENTS 3,457,734 7/1969 Millar ..... 66/42 R
3,811,296 5/1974 Bianchi et al. ..... 66/8
4,538,431 9/1985 Lonati ..... 66/224

FOREIGN PATENT DOCUMENTS 2731091 2/1978 Fed. Rep. of Germany ..... 66/222
623441 7/1961 Italy ..... 66/8
610886 6/1978 U.S.S.R. ..... 66/222

*Primary Examiner*—Wm. Carter Reynolds
*Attorney, Agent, or Firm*—Guido Modiano; Albert Josif

[57] ABSTRACT

The device for locking selectors on the bottom of the needle cylinder grooves in circular knitting machines has a locking element which extends around the needle cylinder of the machine proximate to the lower end of the selectors, accommodated in the grooves of the needle cylinder. The locking element is controllably movable in a direction substantially parallel to the axis of the needle cylinder from an inoperative position, wherein the locking element is arranged substantially below the lower end of the selectors to allow the lower end of the selectors to perform an extraction movement from the related groove in a radial direction with respect to the needle cylinder, to an operative position, wherein at least one portion of the locking element is arranged above the lower end of the selectors for their retention in an inserted position in the related grooves, and vice versa.

18 Claims, 3 Drawing Sheets

DEVICE FOR LOCKING SELECTORS ON THE BOTTOM OF NEEDLE CYLINDER GROOVES IN CIRCULAR KNITTING MACHINES

BACKGROUND OF THE INVENTION

The present invention relates to a device for locking selectors on the bottom of needle cylinder grooves in circular knitting machines.

As is known, circular knitting machines for manufacturing stockings, knitwear and the like, have selectors which are accommodated in the grooves of the needle cylinder below the needles. Said selectors have, proximate to their lower end, a heel directed towards the outside of the needle cylinder which can be engaged with a crown cam which extends around the needle cylinder and has rising portions alternated with descending portions to raise the selectors in a direction parallel to the axis of the needle cylinder so that said selectors raise, in turn, the overlying needles to put them to work, that is to say to directly or indirectly determine the takeup of the thread by the overlying needles.

In practice the choice of the selectors which are to engage with the crown cam determines which needles are to be put to work, unless a subsequent selection is performed; said selection may be performed directly on the needles if needles having long or short heels, engageable or not with movable cams provided around the needle cylinder, are used.

In many types of machine the choice of selectors is performed upstream of each rising portion of the crown cam, which portion is in turn arranged upstream of a feed or drop of the machine, by means of an extraction cam which acts on the selectors, causing the protrusion of their lower end, or at least of the heel arranged proximate thereto, from the related groove of the needle cylinder. The extraction cam may be provided proximate to the upper end of the selectors and act radially from the outside in the direction of the axis of the needle cylinder, or proximate to the lower end of the selectors and act radially from the inside towards the outside; in both cases the selectors have, on their side directed towards the axis of the needle cylinder, a configuration adapted to rest on the bottom of the related groove of the needle cylinder and to allow the selectors an oscillation in radial planes which pass through the axis of the needle cylinder.

Between the extraction cam and the subsequent rising portion of the crown cam, selection devices are provided which, according to the knitting to be performed, are controlled by a machine control element and contact the selectors corresponding to the needles which are not to be put to work, inserting them into the related grooves of the needle cylinder so that their heel, arranged proximate to the lower end, does not engage with the crown cam but passes internally thereto. To allow a considerable possibility of selection, the selectors have, above the heel located proximate to the lower end, a plurality of heels alternated with recesses, and the selection devices generally consist of rods or levers which are actuated so as to interfere or not interfere with said heels to return the related selector to its sunk position or to leave it in extracted position.

If no needle selection is required, i.e. if all the needles are to be put to work or if the selection is performed directly by means of the cams which engage the heels of the needles, all the selectors are inserted into the related grooves before the rising portions of the crown cam. This fact can be obtained by making the extraction cams controllably movable in a radial direction with respect to the needle cylinder, so that when the selectors are not to be used said cams can be moved away from the selectors so as to not interfere therewith, or by extracting and inserting all the selectors successively.

In current circular knitting machines for stockings with rotating needle cylinder, the high rotation speed determines a centrifugal force which tends to move the selectors to their extraction position even without the intervention of the extraction cams. If the extraction of the selectors by centrifugal force occurs downstream the selection devices and before the rising portions of the crown cam, it may occur that the selectors engage with the crown cam, determining errors in the knitting being performed.

Even if this extreme condition does not occur, the selectors continuously contact the levers of the selection devices and the inner side of the crown cam, creating countless wear and breakage problems which considerably limit the life of the selectors and the elements of the machine contacted thereby.

SUMMARY OF THE INVENTION

The aim of the present invention is to eliminate the above described problems by providing a device capable of keeping the selectors, when they are not used, in an inserted position in the related grooves of the needle cylinder even with high rotation speeds of the needle cylinder.

Within this aim, an object of the invention is to provide a device which considerably limits the wear of the selectors and the elements of the machine in contact therewith so as to prevent possible breakages and to allow a longer life thereof.

Another object of the invention is to provide a device with limited dimensions which can be actuated in a simple and reliable manner.

This aim, as well as these and other objects which will become apparent hereinafter, are achieved by a device for locking selectors on the bottom of needle cylinder grooves in circular knitting machines, characterized in that it comprises a locking element extending around the needle cylinder of the machine proximate to the lower end of the selectors accommodated in the grooves of the needle cylinder and controllably movable in a direction substantially parallel to the axis of the needle cylinder from an inoperative position, wherein said locking element is arranged substantially below the lower end of the selectors to allow said lower end of the selectors to perform an extraction movement from the related groove of the needle cylinder in a radial direction with respect to the needle cylinder, to an operative position, wherein at least one portion of said locking element is arranged above the lower end of the selectors for their retention in an inserted position in the related grooves of the needle cylinder, and vice versa.

BRIEF DESCRIPTION OF THE DRAWINGS

Further characteristics and advantages of the invention will become apparent from the description of a preferred but not exclusive embodiment of the device according to the invention, illustrated only by way of non-limitative example in the accompanying drawings, wherein.

DESCRIPTION OF THE PREFERRED EMBODIMENTS

Figures 1, 8:
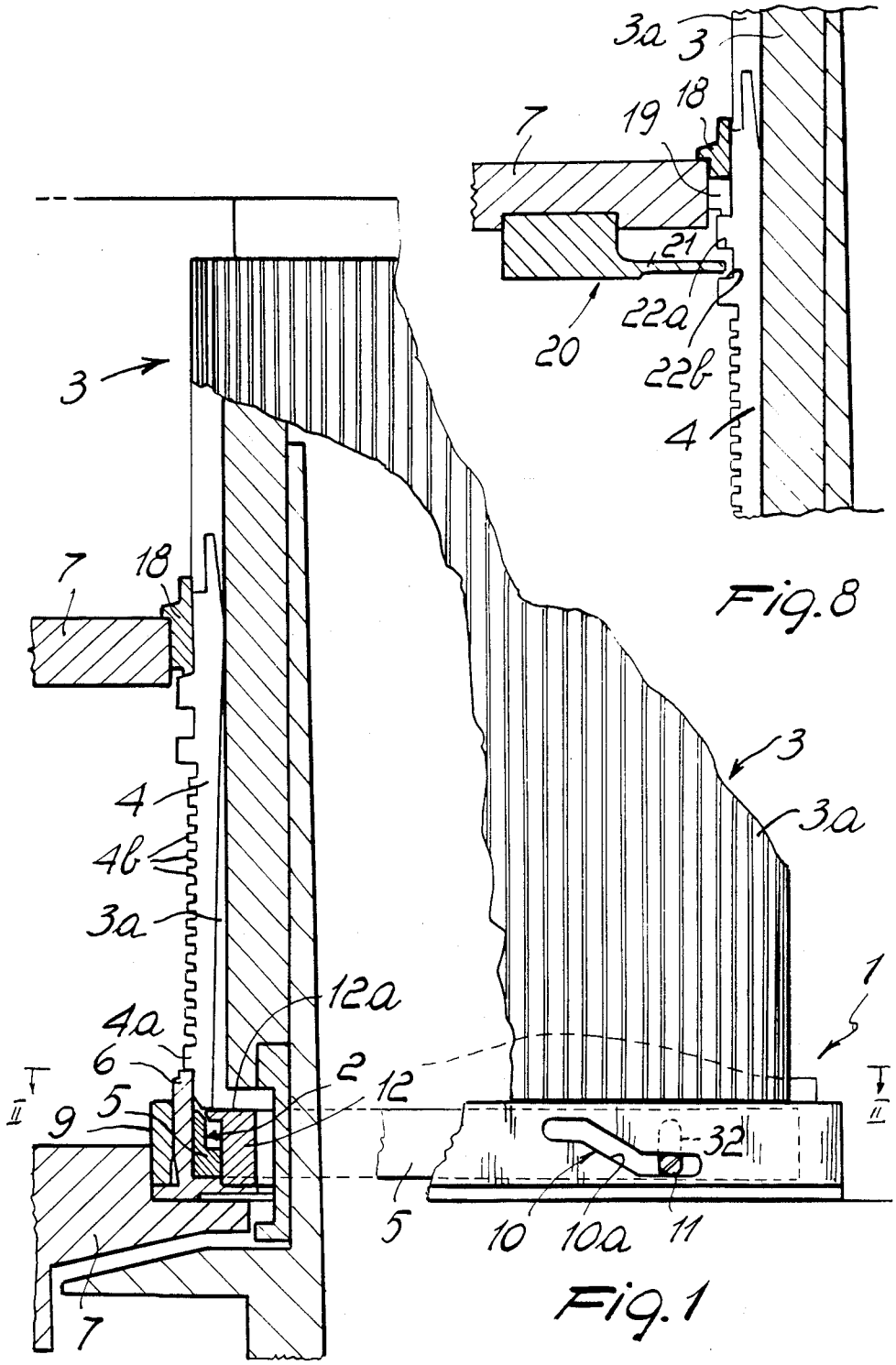
FIG. 1 is a partially cut-away lateral elevation view of the needle cylinder of a circular knitting machine for stockings with the locking element in an inoperative position.
FIG. 8 is a sectional view of a portion of the needle cylinder taken along a radial plane.

With reference to the above described figures, the device according to the invention, generally indicated by the reference numeral 1, comprises a locking element 2 which extends around the needle cylinder 3 of the machine proximate to the lower end of the selectors 4, which are accommodated in a known manner in the grooves 3*a* of the needle cylinder with the possibility of sliding in a direction parallel to the axis of the needle cylinder.

According to the invention, the locking element 2 is controllably movable in a direction parallel to the axis of the needle cylinder 3 from an inoperative position, wherein it is arranged below the lower end of the selectors 4 so that said selectors can be moved with their heel 4*a*, located proximate to said end, in an extraction position, i.e. externally to the related groove 3*a*, to an operative position, wherein said locking element is arranged with at least one portion thereof above the lower end of the selectors 4 to retain them in an inserted position, i.e. having the heel 4*a* inserted into the related groove 3*a*.

More particularly, the locking element 2 is substantially constituted by a ring 5 which is coaxial to the needle cylinder and is arranged inside a crown cam 6 which is also coaxial to the needle cylinder and is fixed to the supporting structure 7 of the machine.

The crown cam 6 is of a known type and has rising portions alternated with descending portions with which the heels 4*a* of the selectors 4 engage when they are extracted from the grooves of the needle cylinder. The rising portions extend, in a known manner, ahead of each feed or drop of the machine, according to the direction of rotation of the needle cylinder, and known selection devices are provided again upstream of each rising portion, e.g. selection levers 8 which are controllably movable in a radial direction with respect to the needle cylinder to interfere with other heels 4*b* of the selectors 4 and to move the selectors to their inserted position in the related grooves of the needle cylinder or to not interfere therewith to keep them in an extracted position so that the heels 4*a* engage with the crown cam 6.

Advantageously, in order to obtain the passage of the locking element 2 from its inoperative position to its operative position or vice versa, control means are provided which comprise an annular body 9 arranged externally and coaxially to the crown cam 6. Said annular body is controllably oscillable about the axis of the needle cylinder 3 and has, on its skirt, at least one slot 10 with a portion 10*a* inclined with respect to the axis of the needle cylinder. In the slot 10 there slideably engages a pin 11 which is fixed to the locking element 2 and passes through a hole 32 defined in the crown cam 6. The configuration of the hole 32 is elongated in the direction of the axis 100 of the needle cylinder so as to allow a translatory motion of the pin 11 and therefore of the ring 5 in a direction parallel to the axis 100 of the needle cylinder and to prevent, at the same time, its rotation about said axis when, upon the oscillation of the annular body 9, the portion 10*a* of the slot 10 acts on the pin 11.

To obtain the oscillation of the annular body 9 about the axis of the needle cylinder, known devices, not illustrated for the sake of simplicity, such as e.g. levers, fluidodynamic pistons, electromagnets, etc. may be used.

In order to achieve a balancing of the forces of the actuation means which act on the locking element, it is convenient to provide two slots 10 and two pins 11 arranged diametrally opposite to one another.

Advantageously, internally and coaxially to the ring 5 there is a supporting ring 12 which is fixed to the crown cam 6 and then to the supporting structure of the machine, and upwardly defines an annular resting region 12*a* for the lower end of the selectors 4. Internally to said supporting ring 12, ahead of each rising portion of the crown cam, there is an extraction cam 13 having at least one portion which is controllably movable, intended to make contact with the side of the selectors directed towards the axis 100 of the needle cylinder, in a radial direction with respect to the needle cylinder to move from an activation position, wherein it contacts the selectors to move the heel 4*a* externally to the related groove 3*a* to undergo the selection performed by the selection device, to an inactivation position wherein it does not interfere with the selectors.

More particularly, each extraction cam 13 has a C-shaped transverse cross section, with the upper end constituted by the actual profile 13*a* intended to contact the selectors.

The extraction cam 13 extends along an arc of a circle and partially embraces the supporting ring 12; the lower end 13*b* of the extraction cam 13 is pivoted, proximate to one of its longitudinal ends, to the supporting structure of the machine below the supporting ring 12 and can oscillate about an axis 14 parallel to the axis 100 of the needle cylinder so as to vary the distance of the profile 13*a* from the axis of the needle cylinder, i.e. so as to pass from the activation position to the inactivation position or vice versa.

To control the oscillation of the extraction cam, known devices, such as levers, fluidodynamic pistons, electromagnets etc. may be used.

In the illustrated case, of a two-feed machine, there are two extraction cams 13.

To allow a greater freedom of oscillation of the extraction cam 13, a recess or missing portion 15 is provided on the inner side of the supporting ring 12, at the extraction cam.

Advantageously, to facilitate the engagement of the ring 5 with the lower end of the selectors, the upper edge of the ring 5 has a guiding bevel 16 which is engageable by sliding, upon the lifting of the ring 5, with a bevel 17 correspondingly provided proximate to the lower end of each selector on the side directed towards the outside of the needle cylinder.

Proximate to their upper end, the selectors are retained in the grooves by a containment ring 18 which extends around the needle cylinder and is shaped complementarily to the crown cam 6 arranged below, to allow in any case the raising of the selectors which engage with the rising portions of said crown cam. Recesses or missing portions 19 may be provided along the profile of the containment ring 18 to allow the extraction or the insertion of the selectors 4 in the related grooves 3*a* of the needle cylinder, as illustrated in particular in FIG. 8.

To prevent the selectors which, upon the lifting of the ring 5, are at said recesses 19 from being moved axially, stop means 20 are provided exactly at said recesses 19.

Said stop means 20 may be advantageously constituted by a small plate 21, fixed to the supporting structure of the machine proximate to the containment ring 18; with the selectors resting on the supporting ring 12, the plate 21 engages between a pair of shoulders 22*a* and 22*b* provided along each selector.

The operation of the device according to the invention is as follows.

Figure 4:
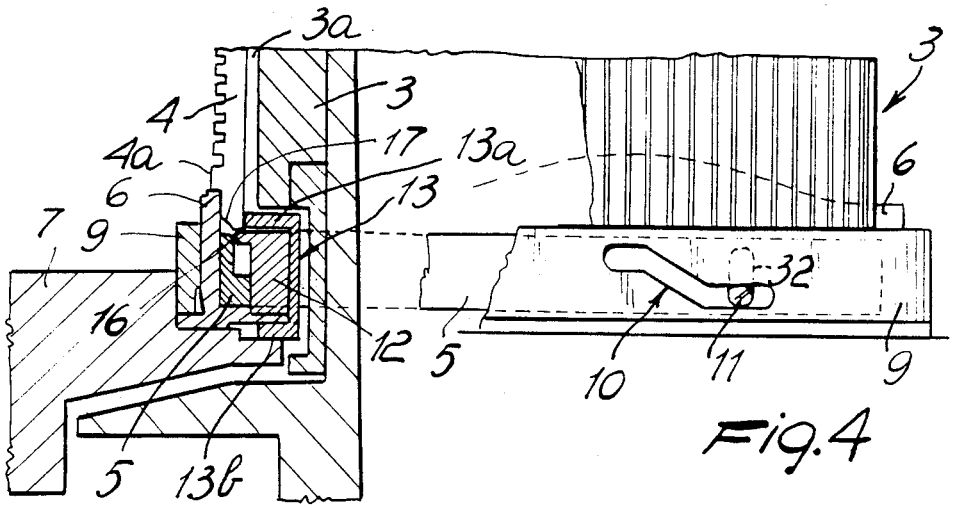
FIGS. 4 and 5 are lateral elevation views of the lower portion of the needle cylinder, partially cutout proximate to an extraction cam to highlight the operation of the device according to the invention.

When the operating steps of the machine require a selection of the needles, the ring 5 is kept in its inoperative position so that the selectors 4 are extracted with their heel 4*a* from the related grooves 3*a* of the needle cylinder 3 to undergo the action of the selection devices, as usually occurs in known machines (FIGS. 1 and 4).

Figure 3:
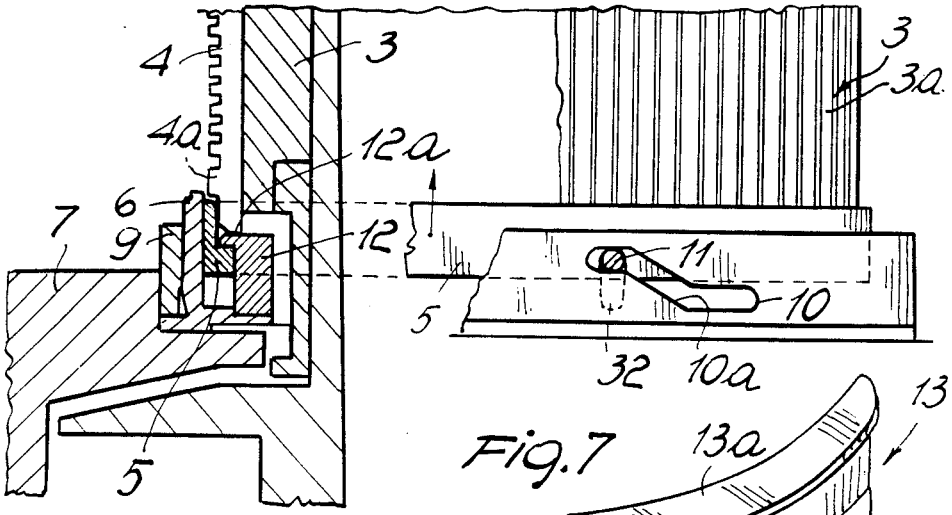
FIG. 3 is a partially cutout lateral elevation view of a portion of the needle cylinder with the locking element in an operative position.
Figure 7:
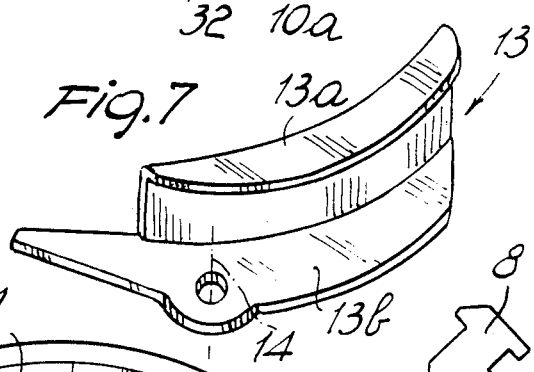
FIG. 7 is a perspective view of an extraction cam.
Figure 2:
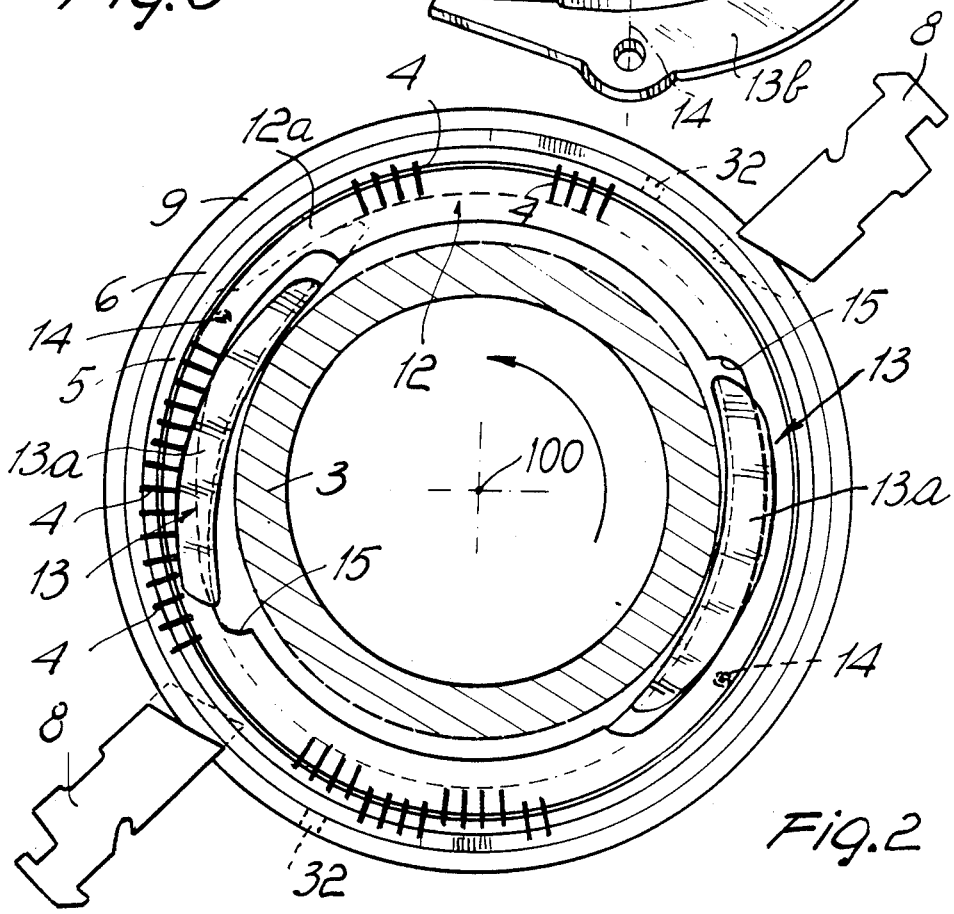
FIG. 2 is a schematic sectional view of FIG. 1 taken along the axis II—II, illustrating two selector extraction cams, one whereof is shown in an activation position.
Figure 6:
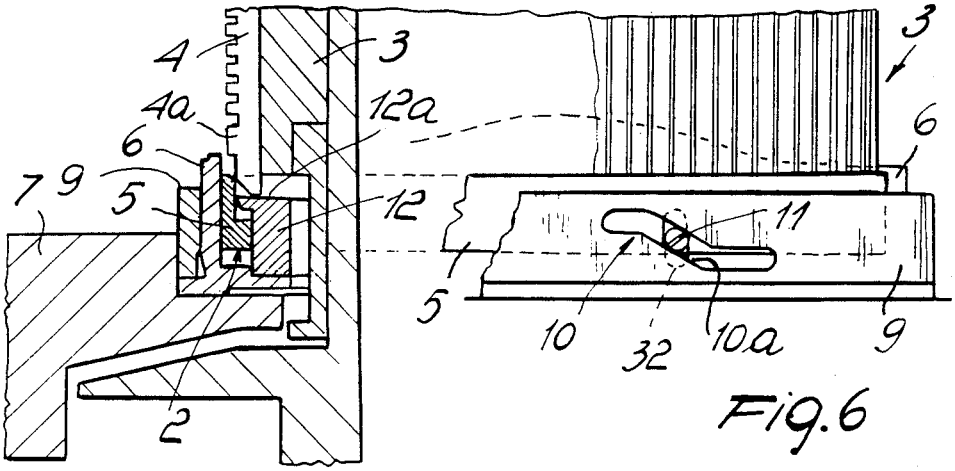
FIG. 6 illustrates, similarly to FIGS. 1 and 3, a partially cut-away lower portion of the needle cylinder, with the device according to the invention during its passage from the inoperative position to the operative position.
Figure 5:
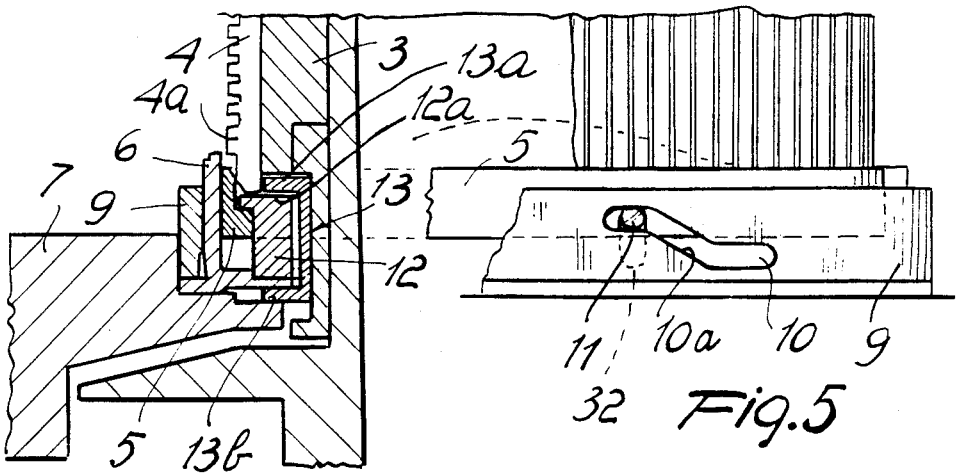

When the knitting steps of the machine do not require a selection of the needles, the extraction cams 13 are moved to their inactivation position and, by means of the oscillation of the annular body 9 about the axis 100 of the needle cylinder, the ring 5 is moved to its operative position, i.e. it is raised so as to engage with the lower end of the selectors and keep them sunk in the related grooves 3*a* of the needle cylinder 3 (FIGS. 3 and 5).

It should be noted that by virtue of the guiding bevellings 16 and 17 the ring 5 can rise even if, in the meantime, one or more selectors have moved to their extraction positions due to the centrifugal force; in this case the ring 5, by rising, returns said selectors to their sunk position in the grooves of the needle cylinder.

Though the coupling between the bevellings 16 and 17 determines an action on the selectors which pushes them upwards, said selectors are kept lowered by the containment ring 18 or by the stop means 20.

When the working phases of the machine again require a selection of the needles, the ring 5 is lowered and again allows the selectors to protrude with their heel 4*a* from the grooves 3*a* by the action of the extraction cams 13 which are again moved to their activation position.

In practice it has been observed that the device according to the invention fully achieves the intended aim, since it safely keeps the selectors inserted inside the grooves of the needle cylinder during the knitting steps of the machine which do not require the use of the selectors, i.e., exactly in the steps wherein the maximum rotation speed of the needle cylinder occurs, allowing the attainment of even higher rotation speeds.

Another advantage resides in the fact that the selector is preserved from continuous impacts against the extraction cams and against the selection devices when use of the selectors is not required.

This fact considerably reduces the wear of the selectors and of the elements of the machine in contact therewith, and therefore considerably reduces the related maintenance interventions.

The device thus conceived is susceptible to numerous modifications and variations, all of which are within the scope of the inventive concept; moreover all the details may be replaced with technically equivalent elements.

In practice, the materials employed, as well as the dimensions, may be any according to the requirements and to the state of the art.

I claim:

1. Device for locking selectors on the bottom of needle cylinder grooves in circular knitting machines, comprising a locking element extending around the needle cylinder of the machine, proximate to the lower ends of the selectors accommodated in the grooves of the needle cylinder, and controllably movable in a direction substantially parallel to the axis of the needle cylinder from an inoperative position, wherein said locking element is arranged substantially below the lower ends of the selectors to allow said lower ends of the selectors to perform an extraction movement from the related groove of the needle cylinder in a radial direction with respect to said needle cylinder, to an operative position, wherein at least one portion of said locking element is arranged above the lower ends of the selectors for their retention in an inserted position in the related grooves of the needle cylinder.

2. Device, according to claim 1, wherein said locking element comprises a ring arranged coaxially to the needle cylinder and internally of a crown cam surrounding the needle cylinder proximate to the lower ends of said selectors, said crown cam being rigidly associated with the supporting structure of the machine.

3. Device, according to claim 1, comprising control means acting on said locking element for its passage from said operative position to said inoperative position and vice versa.

4. Device, according to claim 3, wherein said control means comprise an annular body arranged coaxially and externally to said crown cam, said annular body being operatively connected to said locking element.

5. Device, according to claim 3, wherein said control means comprise an annular body arranged coaxially and externally to said crown cam, said annular body being operatively connected to said locking element, and wherein said annular body has a shaped slot having a portion extending inclined with respect to the axis of the needle cylinder, in said slot there being slideably accommodated a pin traversing said crown cam and rigidly associated with said locking element, said annular body being controllably oscillable about the axis of the needle cylinder to push said pin along said inclined portion of said slot, with consequent movement of said locking element along the axis of the needle cylinder.

6. Device, according to claim 1, wherein inside said locking element there is accommodated a supporting ring fixed to the supporting structure of the machine and defining an annular resting region for the lower ends of the selectors.

7. Device, according to claim 6, wherein in said supporting ring there is arranged at least one extraction cam having at least one controllably movable portion, intended to contact said selectors, and movable in a direction substantially radial to the needle cylinder from an activation position, in which it makes contact with the selectors to move heels of said selectors, located proximate to their lower ends, externally to the related groove of the needle cylinder, to an inactivation position, wherein it does not interfere with said selectors.

8. Device, according claim 1, wherein said locking element has, on its upper edge, a guiding bevel directed towards the axis of the needle cylinder, said guiding bevel being engageable by sliding against a bevel correspondingly provided proximate to the lower end of each selector on the side directed towards the outside of the needle cylinder.

9. Device, according to claim 6, further comprising stop means engageable with said selectors resting on said supporting ring for locking the selectors in a direction parallel to the axis of the needle cylinder.

10. In a circular knitting machine including a needle cylinder having a needle cylinder axis, needle cylinder grooves having bottoms and being formed in said needle cylinder, and selectors accommodated in said needle cylinder grooves and having lower ends, a device for locking said selectors on said bottoms of said needle cylinder grooves comprising;

at least one locking element extending around said needle cylinder and being located proximate to said lower ends of said selectors, said locking element being controllably movable in a direction substantially parallel to said needle cylinder axis from an inoperative position, wherein said locking element is arranged substantially below said lower ends of said selectors for allowing said lower ends of said selectors to perform an extraction movement from said needle cylinder grooves in a radial direction with respect to said needle cylinder, to an operative position, wherein at least one portion of said locking element is arranged above said lower ends of said selectors, for retaining said selectors in an inserted position in said needle cylinder grooves.

11. A circular knitting machine according to claim 10, wherein said locking element comprises at least one ring, said ring being arranged coaxially to said needle cylinder and internally of said crown cam, said crown cam surrounding said needle cylinder proximate to said lower ends of said selectors, said crown cam being rigidly associated with said supporting structure of said circular knitting machine.

12. In a circular knitting machine according to claim 10, further comprising control means, said control means acting on said locking element for moving said locking element from said operative position to said inoperative position and vice versa.

13. In a circular knitting machine according to claim 12, further comprising a supporting structure and a crown cam, and wherein said control means comprise an annular body, said annular body being arranged coaxially and externally to said crown cam and operatively connected to said locking element.

14. In a circular knitting machine according to claim 12, further comprising a supporting structure and a crown cam, and wherein said control means comprise an annular body, said annular body being arranged coaxially and externally to said crown cam and operatively connected to said locking element, and wherein said annular body has at least one shaped slot, said shaped slot having at least one inclined portion, said inclined portion being inclined with respect to said needle cylinder axis, in said slot there being slideably accommodated at least one pin, said pin traversing said crown cam and being rigidly associated with said locking element, said annular body being controllably oscillable about said needle cylinder axis to push said pin along said inclined portion of said slot, with consequent axial movement of said locking element along said needle cylinder axis.

15. In a circular knitting machine according to claim 10, further comprising a supporting structure, and wherein said locking element accommodates at least one supporting ring, said supporting ring being fixed to said supporting structure of said circular knitting machine and defining an annular resting region for said lower ends of said selectors.

16. A circular knitting machine according to claim 15, wherein said selectors have heels located proximate to said lower ends of said selectors, said circular knitting machine further comprising at least one extraction cam, said extraction cam being arranged in said supporting ring and having at least one portion adapted for contacting said selectors, said extraction cam being controllably movable in a substantially radial direction with respect to said needle cylinder from an actuation position, wherein said at least one portion of said extraction cam makes contact with said selectors and said heels are located externally of said needle cylinder grooves, to an inactive position, wherein said at least one portion of said extraction cam does not interfere with said selectors.

17. A circular knitting machine according to claim 10 wherein said needle cylinder defines an outside, and wherein said selectors each define a side directed towards said outside of said needle cylinder, said circular knitting machine further comprising an upper edge defined on said locking element, at least one guiding bevel located on said upper edge and being directed towards said needle cylinder axis, and at least one bevel formed on each of said selectors proximate to each of said lower ends on said side directed towards said outside of said needle cylinder, said guiding bevel being engageable in sliding engagement relationship with said bevel.

18. Device, according to claim 6, further comprising stop means, said stop means being engageable with said selectors resting on said annular resting region of said supporting ring for locking said selectors in a direction parallel to said needle cylinder axis.

* * * * *